US006017665A

United States Patent [19]

Grune et al.

[11] Patent Number: 6,017,665

[45] Date of Patent: Jan. 25, 2000

[54] CHARGE GENERATION LAYERS AND CHARGE TRANSPORT LAYERS AND ORGANIC PHOTOCONDUCTIVE IMAGING RECEPTORS CONTAINING THE SAME, AND METHOD FOR PREPARING THE SAME

[75] Inventors: Guerry L. Grune; Richard R. Harris, both of Virginia Beach, Va.

[73] Assignee: Mitsubishi Chemical America, White Plains, N.Y.

[21] Appl. No.: 09/030,925

[22] Filed: Feb. 26, 1998

[51] Int. Cl.[7] ..... G03G 5/047; G03G 5/04

[52] U.S. Cl. ..... 430/58.2; 430/56; 430/135; 252/501.1

[58] Field of Search ..... 430/56, 58.2, 135; 252/501.1

[56] References Cited

U.S. PATENT DOCUMENTS

| | | | |
|---|---|---|---|
| Re. 33,724 | 10/1991 | Takei et al. | 430/96 |
| 3,037,861 | 6/1962 | Hoegl et al. | 430/80 |
| 3,232,755 | 2/1966 | Hoegl et al. | 430/80 |
| 3,271,144 | 9/1966 | Clausen et al. | 430/91 |
| 3,287,120 | 11/1966 | Hoegl | 430/56 |
| 3,573,906 | 4/1971 | Goffe | 430/67 |
| 3,725,058 | 4/1973 | Hayashi et al. | 430/58.6 |
| 3,837,851 | 9/1974 | Shattuck et al. | 430/58.55 |
| 3,839,034 | 10/1974 | Wiedemann | 430/58.5 |
| 3,850,630 | 11/1974 | Regensburger et al. | 430/58.25 |
| 4,123,270 | 10/1978 | Heil et al. | 430/128 |
| 4,247,614 | 1/1981 | Ohta et al. | 430/79 |
| 4,250,240 | 2/1981 | Shimada et al. | 430/66 |
| 4,251,614 | 2/1981 | Sasaki et al. | 430/79 |
| 4,256,821 | 3/1981 | Enomoto et al. | 430/79 |
| 4,260,672 | 4/1981 | Sasaki et al. | 430/72 |
| 4,268,596 | 5/1981 | Sasaki et al. | 430/72 |
| 4,268,647 | 5/1981 | Keeley | 525/474 |
| 4,293,628 | 10/1981 | Hashimoto et al. | 430/72 |
| 4,464,450 | 8/1984 | Teuscher | 430/60 |
| 4,571,369 | 2/1986 | Yamashita | 430/56 |
| 4,595,602 | 6/1986 | Schank | 430/67 |
| 4,618,555 | 10/1986 | Suzuki et al. | 430/78 |
| 4,664,995 | 5/1987 | Horgan et al. | 430/64 |
| 4,746,756 | 5/1988 | Kazmaier et al. | 564/307 |
| 4,792,508 | 12/1988 | Kazmaier et al. | 430/71 |
| 4,808,506 | 2/1989 | Loutfy et al. | 430/73 |
| 4,833,052 | 5/1989 | Law et al. | 430/73 |
| 4,851,314 | 7/1989 | Yoshihara | 430/96 |
| 4,855,201 | 8/1989 | Badesha et al. | 430/63 |
| 4,874,682 | 10/1989 | Scott et al. | 430/56 |
| 4,882,254 | 11/1989 | Loutfy et al. | 430/78 |
| 4,925,760 | 5/1990 | Baranyi et al. | 430/65 |
| 4,937,164 | 6/1990 | Duff et al. | 585/26 |
| 4,946,754 | 8/1990 | Ong et al. | 430/58.65 |
| 4,952,471 | 8/1990 | Baranyi et al. | 430/128 |
| 4,952,472 | 8/1990 | Baranyi et al. | 430/77 |
| 4,957,839 | 9/1990 | Rokutanzono et al. | 430/66 |
| 4,959,288 | 9/1990 | Ong et al. | 430/64 |
| 4,983,482 | 1/1991 | Ong et al. | 430/96 |
| 5,008,169 | 4/1991 | Yu et al. | 430/60 |
| 5,008,172 | 4/1991 | Rokutanzono et al. | 430/67 |
| 5,011,906 | 4/1991 | Ong et al. | 528/176 |
| 5,030,533 | 7/1991 | Bluhm et al. | 430/126 |
| 5,034,296 | 7/1991 | Ong et al. | 430/126 |
| 5,055,367 | 10/1991 | Law | 430/76 |
| 5,059,355 | 10/1991 | Ono et al. | 252/584 |
| 5,066,796 | 11/1991 | Law | 540/140 |
| 5,077,160 | 12/1991 | Law et al. | 430/60 |
| 5,077,161 | 12/1991 | Law | 430/78 |
| 5,080,987 | 1/1992 | Odell et al. | 430/48 |
| 5,106,713 | 4/1992 | Law | 430/74 |
| 5,130,217 | 7/1992 | Champ et al. | 430/96 |
| 5,227,458 | 7/1993 | Freitag et al. | 528/196 |
| 5,332,635 | 7/1994 | Tanaka | 430/96 |
| 5,378,566 | 1/1995 | Yu | 430/58 |
| 5,554,473 | 9/1996 | Cais et al. | 430/96 |
| 5,595,846 | 1/1997 | Shigematsu et al. | 430/78 |
| 5,670,291 | 9/1997 | Ward et al. | 430/132 |
| 5,856,471 | 1/1999 | Nukada et al. | 430/58 |
| 5,871,877 | 2/1999 | Ong et al. | 430/58 |

FOREIGN PATENT DOCUMENTS

| | | |
|---|---|---|
| 63-292149 | 11/1988 | Japan . |
| 1-134463 | 5/1989 | Japan . |

OTHER PUBLICATIONS

Kirk–Othmer Encyclopedia of Chemical Technology, 4$^{th}$ ed., vol. 9, pp. 245–277, Wiley, New York (1994).

Encyclopedia of Electronics, 2$^{nd}$ ed, Gibilisco et al, Eds., Tab Books, Blue Ridge Summit, PA , pp. 669–671 (1990).

L. H. Sperling, *Introduction to Physical Polymer Science*, John Wiley & Sons, New York, pp. 56–96 (1986).

*Primary Examiner*—Roland Martin

*Attorney, Agent, or Firm*—Oblon, Spivak, McClelland, Maier & Neustadt, P.C.

[57] ABSTRACT

Charge generation layers and charge transport layers which are prepared by coating a substrate with a coating solution prepared by mixing:

(A) a binder;

(B) a charge generation material or a charge transport material; and (C) an organosilanc of the formula:

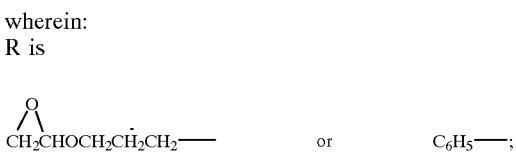

wherein:

R is

R' is H- or $C_{1-4}$-alkyl; and x is an integer of 1 to 3, in a suitable solvent, exhibit enhanced adhesion to the substrate, and organic photoconductive imaging receptors which contain such a charge generation layer and/or charge transport layer exhibit improved lifetimes.

21 Claims, No Drawings

CHARGE GENERATION LAYERS AND CHARGE TRANSPORT LAYERS AND ORGANIC PHOTOCONDUCTIVE IMAGING RECEPTORS CONTAINING THE SAME, AND METHOD FOR PREPARING THE SAME

BACKGROUND OF THE INVENTION

1. Field of the Invention

The present invention relates to charge generation layers (CGLs) and charge transport layers (CTLs) which are prepared by coating a substrate with a coating solution prepared by dissolving a binder, a specified organosilane, and either a charge generation material (CGM) or a charge transport material (CTM) in a suitable solvent. The present invention also relates to organic photoconductive imaging receptors which contain such a CGL and/or CTL and processes for preparing such a CGL and CTL.

2. Discussion of the Background

A general discussion of electrophotography (photocopying) is given in *Kirk-Othmer, Encyclopedia of Chemical Technology*, 4th ed, vol. 9, pp. 245–277, Wiley, N.Y. (1994), and a brief description of laser beam printing is provided in *Encyclopedia of Electronics*, 2nd ed, Gibilisco et al, Eds., pp. 669–671, TAB BOOKS, Blue Ridge Summit, Pa. (1990), both of which are incorporated herein by reference.

Photoreceptors are the central device in photocopiers and laser beam printers. In most photocopiers and laser beam printers, the photoreceptor surface is contained on the outside surface of a hollow metal cylinder, called a drum. Typically, the drum is made of a metal, such as aluminum, which may be anodized or coated with a thin dielectric layer (injection barrier) which is in turn over coated with photogeneration and photoconduction layers.

Key steps in transfer electrophotography include the charging step, the exposure step, the development step, and the transfer step. In the charging step, ions are deposited on the surface of the photoconductor drum. In the exposure step, light strikes the charged photoreceptor surface and the surface charges are neutralized by mobile carriers formed within the photoreceptor layer. Thus, the charge on the surface is transmitted in the exposed areas of the photoconductive layer to the oppositely charged metal substrate of the drum. In the development step, a thermoplastic pigmented powder (toner) which carries a charge is brought close to the photoreceptor so that toner particles are directed to the charged image regions on the photoreceptor. In the transfer step, a sheet of paper is brought into physical contact with the toned photoreceptor, and the toner is transferred to the paper by applying a charge to the backside of the paper.

Presently, the most suitable photoconductive imaging receptors for low and medium speed electrophotographic plain-paper copiers and laser printers have a double-layered configuration. Photogeneration of charge carriers (electron-hole pairs) takes place in a thin charge generation layer (CGL), typically 0.1 to 2.0 $\mu$m thick, which is coated on a conductive substrate such as an aluminum alloyed drum. After photogeneration, mobile carriers (usually holes) are injected into a thicker charge transport layer (CTL), which is about 10 to 40 $\mu$m thick and coated on top of the CGL, under an electric field gradient provided by a negative surface charge. These holes drift to the outermost layer of the photoreceptor to selectively neutralize surface charge, thereby forming a latent electrostatic image, which is subsequently developed by thermoplastic toner.

The physical durability of the organic photoconductive imaging receptor is the major characteristic that determines service lifetime, and such durability depends on the mechanical properties of the surface CTL. The CTL is formulated from two major components. They are electron-donor molecules responsible for hole transport, known as the charge-transport material (CTM), and an appropriate binder resin, which must be amorphous and transparent to light. The CTM is usually a low molecular weight organic compound with arylamine or hydrazone groups, and it is selected primarily on the basis of solubility, compatibility with the binder resin, charge transport property, and electrophotographic cyclic stability. The CTM is a non-reactive binder resin diluent (molecular dopant), and it must be compatible in approximately equal parts by weight with the binder resin to ensure good charge mobility, which involves electron hopping between adjacent molecules of the CTM.

The role of the binder resin is to impart the physical durability necessary for acceptable lifetime under the service conditions encountered in copiers and printers. It is well known that the most suitable binder resins belong to the general class of aromatic polycarbonates (PCR), which exhibit such desirable characteristics as solubility (to allow film coating from solution), high carrier mobility, compatibility with the CTM, transparency, durability, adhesion to the CGL, and so on. The simplest and best known example is bisphenol-A polycarbonate (BPA-PCR), more formally called poly[2,2-bis-(4-phenylene)propane carbonate], which has good impact strength and toughness.

Organic photoconductive imaging receptors are conveniently prepared by the dip-coating process, in which a substrate is dipped into a first solution which contains a solvent in addition to the ingredients of the CGL and, after drying, the CGL-coated substrate is dipped into a second solution which contains a solvent in addition to the ingredients of CTL. However, when forming a CTL by the dip-coating process, the thickness of the CTL is not uniform near the edge of the CTL at the point where the substrate was not immersed in the solution. Specifically, the thickness of the CTL increases from the edge until it reaches a plateau, which represents the thickness of the CTL over the bulk of the CTL. The distance between the edge of the CTL and the point where the thickness of the CTL levels off is referred to as the drop zone. To maximize the production of the CTL, it is desired to minimize the drop zone.

Moreover, it has been found that certain CTMs do not exhibit the same solubility in PCRs as others. This can lead to poor adhesion between the substrate and the CGL/CTL.

Thus, there remains a need for improved CGLs and CTLs which exhibit improved adhesion to the substrate. There also remains a need for organic photoconductive imaging receptors which contain such a CGL and/or CTL and processes for preparing such a CGL and/or CTL and such organic photoconductive imaging receptors.

SUMMARY OF THE INVENTION

Accordingly, it is one object of the present invention to provide novel CGLs which exhibit increased adhesion to the substrate.

It is another object of the present invention to provide novel organic photoconductive imaging receptors which contain such a CGL.

It is another object of the present invention to provide a novel process for preparing such a CGL and such organic photoconductive imaging receptors.

It is another object of the present invention to provide novel CTLs which exhibit increased adhesion to the substrate.

It is another object of the present invention to provide novel organic photoconductive imaging receptors which contain such a CTL.

It is another object of the present invention to provide a novel process for preparing such a CTL and such organic photoconductive imaging receptors.

These and other objects, which will become apparent during the following detailed description, have been achieved by the inventors' discovery that CGLs and CTLs which are prepared by coating a substrate with a coating solution prepared by dissolving:

(A) a binder;

(B) a CGM or a CTM; and (C) an organosilane of the formula:

$$R_xSi(OR')_{4-x}$$

wherein:

R is

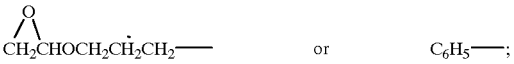

R' is H- or $C_{1-4}$-alkyl; and x is an integer of 1 to 3, in a suitable solvent, exhibit enhanced adhesion to the substrate and that the functional life of an organic photoconductive imaging receptor containing such a CGL and/or CTL is increased.

DETAILED DESCRIPTION OF THE PREFERRED EMBODIMENTS

Thus, in a first embodiment, the present invention provides novel CGLs and CTLs which are prepared by coating a substrate with a coating solution prepared by dissolving:

(A) a binder;

(B) a CGM or a CTM; and (C) an organosilane of the formula:

$$R_xSi(OR')_{4-x}$$

wherein:

R is

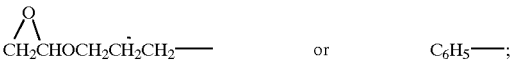

R' is H- or $C_{1-4}$-alkyl; and x is an integer of 1 to 3, in a suitable solvent.

When preparing a CGL using a CGM, the binder is suitably selected from a wide range of "insulating" resins or organic photoconductive polymers such as poly-N-vinylcarbazole, polyvinylanthracene, polyvinylpyrene, and the like. Preferable insulating resins are polyvinyl butyral, polyacrylate (condensation polymer of bisphenol A and phthalic acid, etc.), polycarbonate, polyester, phenoxy resins, polyvinyl acetate, acrylic resin polyacrylamide resin, polyamide, polyvinyl pyridine, cellulose series resins, urethane resins, epoxy resins, casein, polyvinyl alcohol, and polyvinyl pyrrolidone, and the like. Preferably, the binder used in the production of the present CGLs is a mixture of polyvinyl butyral acetate and a polyhydroxyether which is a polymer of 4,4'-(1-methylethylidene)bisphenol with (chloromethyl)oxirane (PKHH). Suitably, the resin content of the CGL is not more than 80 wt. %, preferably not more than 40 wt. %, based on the dry weight of the CGL.

Suitable CGMs include:

(1) Azo (mono-, bis, and tris) pigments as disclosed in U.S. Pat. Nos. 4,123,270, 4,247,614, 4,251,614, 4,251,614, 4,256,821, 4,260,672, 4,268,596, 4,268,647, and 4,293,628 (all of which are incorporated herein by reference);

(2) Phthalocyanine pigments such as metal phthalocyanines and metal-free phthalocyanines;

(3) Indigo pigments such as indigo and thioindigo;

(4) Perylene pigments such as perylene anhydrides and perylene imides;

(5) Polycyclic quinone pigments such as anthraquinone and pyrenequinone;

(6) Squarilium dyes;

(7) Pyrilium salts;

(8) Triphenylmethane dyes; and (9) the like.

Preferred CGMs include those of types (1) and (2) given above. These include the crystalline oxytitanium (metal-free) phthalocyanine as described in U.S. Pat. No. 5,059,355 (incorporated herein by reference), more preferably the mixed crystal phthalocyanine described in U.S. Pat. No. 5,595,846 (incorporated herein by reference). Equally suitable is the azo-type compound described in U.S. Pat. No. 4,618,555 (incorporated herein by reference).

Suitable organosilanes are those having the formula:

$$R_xSi(OR')_{4-x}$$

wherein:

R is

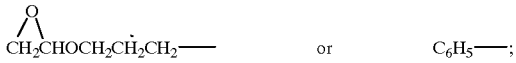

R' is H- or $C_{1-4}$-alkyl; and x is an integer of 1 to 3.

Specific examples of suitable organosilanes include glycidyloxypropyltrimethoxysilane; glycidyloxypropyltrimethoxysilane, which has been hydrolyzed or partially hydrolyzed with deionized water; phenoxytrimethoxysilane; and phenoxytrimethoxysilane, which has been hydrolyzed or partially hydrolyzed with deionized water. Good results have been achieved using partially hydrolyzed glycidyloxypropyltrimethoxysilane and unhydrolyzed phenoxytrimethoxysilane. The organosilane is suitably hydrolyzed by simply shaking the organsilane with 0.01 to 4 moles, preferably 0.025 to 1 moles, of water per moles of organosilane.

The present CGLs are prepared by dissolving the binder, the CGM, and the organosilane in an appropriate solvent. The resulting solution is coated on a substrate, and the resulting coat is dried to afford the CGL. Suitable solvents for dissolving the binder, the CGM, and the organosilane include cyclohexanone, isopropanol, or monoglyme. Good results have been achieved by first dissolving the binder and the CGM in the solvent and then adding the organosilane. Typically, the present CGL coating solution will be prepared by grinding a suspension of a finely divided photogeneration compound such as a phthalocyanine or bisazo pigment and a dissolved resin such as poly(vinyl butyral) in an organic solvent such as cyclohexanone, isopropanol, or monoglyme with glass beads in a sand mill for several hours at low temperature, then pouring the dispersion in a solution of the stabilizing polymer, and finally adding the organosilane.

Typically, the binder and the CGM are dissolved in the solvent in relative amounts which correspond to the weight proportions of binder and CGM desired in the CGL. Suitably, the solution used to prepare the present CGL will be prepared by dissolving the CGM and the binder in a weight ratio of 0.1:1:0 to 1.5:1.0. For photocopiers, the CGM:binder weight ratio is normally about 1:1, while in laser printers, the CGM:binder weight ratio is normally about 0.5:1. In absolute terms, the binder and the CGM are each typically dissolved in the solvent in a concentration of 1 to 5 weight %, preferably 2 to 4 weight %, based on the weight of the solvent. The organosilane is suitably added in a relative amount of 10 to 200 weight %, preferably 50 to 150 weight %, more preferably about 100 weight %, based on the weight of CGM.

The solution prepared by dissolving the binder, the CGM, and the organosilane may be coated on the substrate by any conventional method, including spray coating, nozzle coating, spin coating, and dip coating. For the production of organic photoconductive imaging receptors, the solution is typically coated on the substrate by dip coating. Dip coating to form a CGL is well known to those skilled in the art, and the production of a CGL having a desired thickness can be readily achieved by varying the rate of removal of the substrate from the coating solution, the viscosity of the solution, and/or the solid content of the solution. Typically, the present CGL will have a thickness of 0.1 to 1.5 $\mu$m, most preferably 0.1 to 0.75 $\mu$m.

Suitably, the substrate can take on a variety of sizes and shapes, such as pipes, discs, plates, belts, etc., and be made from a wide range of rigid or flexible materials. When preparing an organic photoconductive imaging receptor for a photocopier or laser printer, it is preferred that the substrate be in the form of a hollow cylinder, called a pipe or drum, and is made of a conductive metal. Alternatively, the substrate may be a polymer, such as polycarbonate, polyethylene, polypropylene, polyester (e.g., poly(ethylene terephthalate)), polyamide, etc.

Although there are no particular size limitations placed on the metal or polymeric drum, such drums are typically a hollow cylinder which is 25 to 100 cm long and 16 to 140 cm in outer diameter. Typically, the thickness of the drum is 0.5 to 5 mm, and thus the inner diameter of the drum is usually close in size to the outside diameter of the drum.

There is no particular limitation on the metal which composes the metal or polymeric drum, and any of those used conventionally in the art may be employed. Preferably, the metal drum is an anodized and sealed aluminum drum. Such anodized aluminum drums may be prepared by the conventional methods well known in the art.

The drying of the CGL coat to afford the CGL can be carried out using conventional methods. The exact temperature and time for the drying will depend on such factors as the thickness of the CGL, the solvent used in the coating process, and the amounts of the binder, CTM, and organosilane used to prepare the CGL coating solution. Typically, good results are achieved by drying at ambient temperatures (15 to 30° C.) for a time of about 1 to 10 minutes.

When preparing a CTL, a CTM is used rather than a CGM. When preparing a CTL, the binder may be any which is conventionally used for the production of CTLs. Preferably, the CTL binder is a polycarbonate binder. The polycarbonate binder may be any which is conventionally used in the preparation of CTLs. For example, the simplest and best known example is bisphenol-A polycarbonate (BPA-PCR), more formally called poly[2,2-bis-(4-phenylene)propane carbonate], which has good impact strength and toughness.

Polycarbonates obtained from dihydroxydiphenyl cycloalkanes are disclosed in U.S. Pat. No. 5,227,458, which is incorporated herein by reference, and electrophotographic photosensitive layers containing a specified polycarbonate are disclosed in U.S. Pat. No. 5,332,635, which is also incorporated herein by reference.

The use of poly[1,1-bis-(4-phenylene)cyclohexane carbonate], commonly known as BPZ-PCR, a commercial product designated "IUPILON Z" from Mitsubishi Gas Chemical of Japan, as an improved polycarbonate binder resin for organic photoconductive imaging receptors is disclosed in U.S. Pat. No. Re. 33,724, which is incorporated herein by reference.

Electrophotographic photosensitive members which contain a photosensitive layer containing at least one polycarbonate resin (I) having a number-average molecular weight of $1.5\times10^4$ or less and at least one polycarbonate resin (II) having a number-average molecular weight of $4.5\times10^4$ or more are disclosed in U.S. Pat. No. 4,851,314, which is incorporated herein by reference.

Alternative suitable polycarbonate binders include those having a bimodal molecular weight distribution and are made up of a mixture of two polymers having different molecular weights. Such polycarbonates having a bimodal molecular weight distribution are disclosed in copending U.S. patent application Ser. No. 08/885,662, filed on Jun. 30, 1997, now abandoned, which is incorporated herein by reference. Specifically, copending U.S. patent application Ser. No. 08/885,662, now abandoned, discloses polycarbonates which have bimodal molecular weight distribution and comprise:

(a') 70 to 90% by weight, based on the total weight of (a') and (a"), of poly[1,1-bis-(4-phenylene)cyclohexane carbonate] having a $M_n$ of 14,000 to 24,000 and a $M_w$ of 56,000 to 66,000; and (a") 10 to 30% by weight, based on the total weight of (a') and (a"), of poly[1,1-bis-(4-phenylene)cyclohexane carbonate] having a $M_n$ of 31,000 to 41,000 and a $M_w$ of 230,000 to 330,000.

Polycarbonate (a') has a $M_n$ of 14,000 to 24,000, preferably 16,500 to 21,500, more preferably 18,000 to 20,000, most preferably about 19,000. Polycarbonate (a') also has a $M_w$ of 56,000 to 66,000, preferably 58,500 to 63,500, more preferably 60,000 to 62,000, most preferably about 61,000. Polycarbonate (a') also has a $M_z$ of 89,000 to 99,000, preferably 91,500 to 96,500, more preferably 93,000 to 95,000, most preferably about 94,000. Polycarbonate (a') also has a $M_p$ of 60,000 to 70,000, preferably 62,500 to 67,500, more preferably 64,000 to 66,000, most preferably about 65,000. Polycarbonate (a') also has a Dispersion of 2.33 to 4.71, preferably 2.72 to 3.85, more preferably about 3.00 to 3.44, most preferably about 3.21.

Polycarbonate (a") has a $M_n$ of 31,000 to 41,000, preferably 33,500 to 38,500, more preferably 35,000 to 37,000, most preferably about 36,000. Polycarbonate (a") also has a $M_w$ of 230,000 to 330,000, preferably 255,000 to 305,000, more preferably 270,000 to 290,000, most preferably about 280,000. Polycarbonate (a") also has a $M_z$ of 450,000 to 550,000, preferably 475,000 to 525,000, more preferably 490,000 to 510,000, most preferably about 500,000. Polycarbonate (a") also has a $M_p$ of 190,000 to 290,000, preferably 215,000 to 265,000, more preferably 230,000 to 250,000, most preferably about 240,000. Polycarbonate (a") also has a Dispersion of 5.61 to 10.65, preferably 6.62 to 9.10, more preferably about 7.29 to 8.28, most preferably about 7.77.

The use of polycarbonate binders, which comprise:

(a) 10 to 90% by weight, based on the total weight of (a) and (b), of poly[1,1-bis-(4-phenylene)cyclohexane carbonate]; and (b) 10 to 90% by weight, based on the total weight of (a) and (b), of poly[2,2-bis-(4-(3-methylphenylene)) propane carbonate] is disclosed in copending U.S. patent application Ser. No. 08/926,990, which is also incorporated herein by reference. Specifically, the polycarbonate binders disclosed in U.S. patent application Ser. No. 08/926,990 comprise two structurally distinct polycarbonates having repeating units of the formulae (I) and (II):

(I)

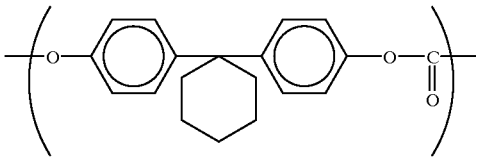

BPZ-PCR or poly[1,1-bis-(4-phenylene)cyclohexane carbonate] (I)

(II)

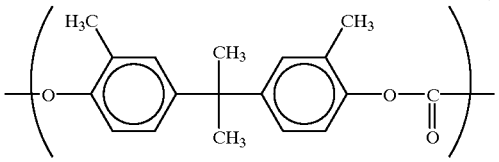

BPC-PCR or poly[2,2-bis-(4-(3-methylphenylene)) propane carbonate] (II)

Polycarbonate (a) may have a monomodal molecular weight distribution or may have a bimodal molecular weight distribution. When polycarbonate (a) has a monomodal molecular weight distribution, it suitably has a number-average molecular weight ($M_n$) of 22,000 to 32,000, preferably 24,500 to 29,500, more preferably 27,000 to 27,5000; a weight-average molecular weight ($M_w$) of 78,000 to 88,000, preferably 80,500 to 85,500, more preferably 82,000 to 83,000; a Z-average molecular weight ($M_z$) of 130,000 to 140,000, preferably 132,5000 to 137,500, more preferably 134,000 to 135,000; a gel-permeation-peak-molecular weight ($M_p$) of 70,000 to 80,000, preferably 72,500 to 77,500, more preferably 75,000 to 76,500; and a Dispersion of 2.80 to 3.20, preferably 2.90 to 3.10, more preferably about 3.00.

Alternatively, polycarbonate (a) may have a bimodal molecular weight distribution and thus be made up of a mixture of two polymers having different molecular weights, such as described above in the context of copending U.S. patent application Ser. No. 08/885,662.

Polycarbonate (b) suitably has a $M_n$ of 22,000 to 32,000, preferably 24,500 to 29,500, more preferably 27,000 to 27,500; a $M_w$ of 78,000 to 88,000, preferably 80,500 to 85,500, more preferably 82,000 to 83,000; a $M_z$ of 130,000 to 140,000, preferably 132,500 to 137,500, more preferably 134,000 to 136,000; a $M_p$ of 70,000 to 80,000, preferably 72,500 to 77,500, more preferably 75,000 to 76,500; and a Dispersion of 2.80 to 3.20, preferably 2.90 to 3.10, more preferably about 3.00.

In a preferred embodiment, polycarbonate (a) is a mixture of (a') and (a"), wherein (a') is "IUPILON Z-200" and (a") is "IUPILON Z-800", both of which are commercially available from Mitsubishi Gas Chemical of Japan. In another preferred embodiment, polycarbonate (b) is "BPC$_{(L)}$-PCR" or "BPC$_{(H)}$-PCR", which are products of Mitsubishi Chemical Co. In a particularly preferred embodiment, polycarbonate (a) is a mixture of (a') and (a"), wherein (a') is "IUPILON Z-200" and (a") is "IUPILON Z-800", and polycarbonate (b) is "BPC$_{(L)}$-PCR" or "BPC$_{(H)}$-PCR".

The measurement and calculation of $M_n$, $M_w$, $M_z$, and Dispersion are described in L. H. Sperling, *Introduction to Physical Polymer Science*, John Wiley & Sons, New York, Chapter 3, pp. 56–96 (1986), which is incorporated herein by reference. $M_n$, $M_w$, and $M_z$ are defined by the following formulae:

$$M_n = \frac{\sum_i N_i M_i}{\sum_i N_i} = \frac{\sum_i w_i}{\sum_i (w_i / M_i)} \quad (1)$$

$$M_w = \frac{\sum_i N_i M_i^2}{\sum N_i M_i} = \frac{\sum_i w_i M_i}{\sum w_i} \quad (2)$$

$$M_z = \frac{\sum_i N_i M_i^3}{\sum N_i M_i^2} = \frac{\sum_i w_i M_i^2}{\sum w_i M_i} \quad (3)$$

wherein $N_i$ is the number of molecules having the molecular weight $M_i$; and $w_i$ is the weight of the species having molecular weight $M_i$.

In particular, $M_n$ and $M_w$ may be calculated from the gel permeation chromatogram of a polymer using the universal calibration procedure as described on pages 85–89 of L. H. Sperling, *Introduction to Physical Polymer Science*, John Wiley & Sons, New York (1986).

The Dispersion is defined as:

$$\text{Dispersion} = \frac{M_w}{M_n}$$

Any conventional CTM may be used in the present CTL. Typically, such CTMs are low molecular weight organic compounds with arylamine or hydrazone groups. Suitable CTM are disclosed in U.S. Pat. Nos. 3,037,861, 3,232,755, 3,271,144, 3,287,120, 3,573,906, 3,725,058, 3,837,851, 3,839,034, 3,850,630, 4,746,756, 4,792,508, 4,808,506, 4,833,052, 4,851,314, 4,855,201, 4,874,682, 4,882,254, 4,925,760, 4,937,164, 4,946,754, 4,952,471, 4,952,472, 4,959,288, 4,983,482, 5,008,169, 5,011,906, 5,030,533, 5,034,296, 5,055,367, 5,066,796, 5,077,160, 5,077,161, 5,080,987, 5,106,713, 5,130,217, and 5,332,635, which are incorporated herein by reference.

Alternatively, as the CTM there may be used electron transfer materials and/or hole transfer materials. As the hole transfer materials there may be used polycyclic aromatics such as naphthalene, anthracene, pyrene, and the like; carbazoles, such as N-ethyl carbazole, N-isopropyl carbazole, and the like; hydrazones, such as N-methyl-N-phenylhyrazino-3-methylidene-9-ethylcarbazole, N,N-diphenylhydrazino-3-methylidene-10-ethylphenoxazine, p-diethylaminobenzaldehyde-N,N-diphenylhydrazone, p-diethylaminobenzaldehyde-N-alpha-naphthyl-N-phenylhydrazone, 1,3,3-trimethylindolino-omega-aldehyde-N-phenylhydrazone, p-diethylbenzaldehyde-3-methylbenzthiazolino-2-hydrazone, and the like;

pyrazolines such as 2,5-bis(p-diethylaminophenyl)-1,3,4-oxadiazole, 1-phenyl-3-(p-diethylaminostyryl)-5-(p-diethylaminophenyl)pyrazoline, 1-[quinolyl(2)]-3-(p-diethylaminophenyl)pyrazoline, spiropyrazoline, and the like; oxazole compounds such as 2-(p-diethylamilostyryl)-6-diethylaminobenzoxazole, 2-(p-diethylaminostyryl)-4-diethylaminobenzoxazole, 5-(2-chlorophenyl)oxazole, and the like: triarylmethanes such as bis-(4-diethylamino-2-methylphenyl)phenylmethane and the like; polyarylalkanes such as 1,1-bis-(4-N,N-diethylamino-2-methylphenyl) ethane, and the like; triphenylamine, poly-N-vinyl carbazoles, polyvinyl acridines, poly-9-vinylphenylanthracenes, pyrene-formaldehyde resin, N-ethyl carbazole formaldehyde resin, and the like.

Preferred CTM include the diphenylhydrazone derivatives 1-pyrenealdehyle dyphenylhydrazone (PY-DPH) and 3-carbazolealdehyde diphenylhydrazone (CZ-DPH), and benzenamine, 4,4-[methylenebis(oxy)]bis[N-phenyl-N-[4-(2-phenylethenyl)phenyl]. Suitable and preferred organosilanes for use in the present CTLs are those described above in the context of the present CGLs.

The present CTL is prepared by dissolving the polycarbonate binder, the CTM, and the organosilane in an appropriate solvent. The resulting solution is coated on a substrate, and the resulting coat is dried to afford the CTL. Suitable solvents for dissolving the polycarbonate binder, the CTM, and the organosilane include methylene chloride, methyl ethyl ketone, tetrahydrofuran, dioxane, chlorobenzene, toluene, and mixtures thereof. Good results have been achieved by first dissolving the polycarbonate binder and the CTM in the solvent and then adding the organosilane.

Typically, the polycarbonate binder and the CTM are dissolved in the solvent in relative amounts which correspond to the weight proportions of polycarbonate binder and CTM desired in the CTL. Suitably, the solution used to prepare the present CTL will be prepared by dissolving the CTM and the polycarbonate binder, in a weight ratio of 0.3:1.0 to 1.5:1.0, preferably about 1.0:1.0. In absolute terms, the polycarbonate binder and the CTM are typically each dissolved in the solvent in a concentration of 1 to 20 weight %, preferably 5 to 15 weight %, more preferably about 10 weight %, based on the weight of the solvent. The organosilane is suitably added in an amount of from 1 to 75 weight %, preferably from 2 to 50 weight %, based on the weight of the CTM in the CTL solution.

The solution prepared by dissolving the polycarbonate binder, the CTM, and the organosilane may be coated on the substrate by any conventional method, including spray coating, nozzle coating, spin coating, and dip coating. For the production of organic photoconductive imaging receptors, the solution is typically coated on the substrate by dip coating. Dip coating to form a CTL is well known to those skilled in the art, and the production of a CTL having a desired thickness can be readily achieved by varying the rate of removal of the substrate from the coating solution, the viscosity of the solution, and/or the solid content of the solution. Typically, the present CTL will have a thickness of 10 to 40 $\mu$m, most preferably 15 to 30 $\mu$m.

The CTL may further comprise antioxidants, electron acceptors to stabilize residual charge, and a silicone leveling oil.

In another embodiment, the present invention provides novel organic photoconductive (OPC) imaging receptors which contain either the present CGL, the present CTL, or, preferably, both the present CGL and the present CTL. When preparing an OPC imaging receptor, the substrate (metal drum) will usually be coated with a CGL prior to the formation of the CTL. Thus, the organic photoconductive imaging receptor of the present invention will typically be an anodized aluminum drum which is coated on its outside surface with the present CGL which in turn is coated on its outside surface with the present CTL. In certain cases, a thin (submicron) charge-blocking layer consisting of an insulating polymeric resin may be interposed between the metal drum surface and the CGL.

Depending on the final application of the photoconductor drum, the entire outside surface of the drum may be coated with the photoconductive layer, or the photoconductive layer may be omitted from either one or both of the end portions of the outside surface of the photoconductor drum. The omission of the photoconductive layer from a single end region of the drum may be accomplished by simply controlling the depth of immersion of the drum into the coating bath during the coating step, and the omission of the photoconductive coating from both ends of the drum can be accomplished by combining controlling the depth of immersion with either wiping the end portion of the drum immersed in the coating bath or equipping this end portion with a mask prior to and during immersion.

The drying of the CTL coat to afford the CTL can be carried out using conventional methods. The exact temperature and time for the drying will depend on such factors as the thickness of the CTL, the solvent used in the coating process, and the amounts of the polycarbonate binder, the CTM, and the organosilane used to prepare the coating solution. Typically, good results are achieved by drying in an oven at a temperature of from 100 to 135° C., for a time of 20 to 40 min.

Preferably, the organic photoconductive imaging receptor, which contains both a CGL and a CTL, is subjected to a final drying in an oven at a temperature of from 230 to 262° C., for a time of 30 to 50 min.

According to the present invention, durable CGLs and CTLs for OPC imaging receptors are provided which result in an extended lifetime of the OPC imaging receptors.

Other features of the invention will become apparent in the course of the following descriptions of exemplary embodiments which are given for illustration of the invention and are not intended to be limiting thereof.

EXAMPLES

I. General Methods.

A. Preparation of Organic Photoconductors (OPC).

In the following Examples, the substrates coated were hollow aluminum cylinders or drums, with diameters of 16 to 140 mm and lengths from 250 to 1000 mm, with surfaces that were either mirror finished by diamond turning, or anodized to create a charge-blocking layer. The surface was cleaned and/or degreased by either trichloroethylene or aqueous-based cleaning with the application of ultrasonic vibrational energy, vapor rinsing, and/or brush scrubbing. Subsequent coating operations were carried out in a clean room environment (class 100 or better). The CGL was formed by dip-coating the substrate in the CGL coating solution. After drying, the CTL was formed by dip-coating the CGL-coated substrate in the CTL coating solution, followed by drying.

Unless otherwise indicated all amounts listed in the Examples are given in terms of parts by weight. A list of materials used in the Examples is given below.

B. Test Procedure for Adhesion

The adhesion test is an extension of the standard "cross-hatch" method which requires a stainless steel knife blade and a "template." The template is used as a guide for the technician as he/she performs a cross-hatch cutting pattern of the OPC coatino within the prescibed 2"×1.5" rectangular section. Next, cellophane adhesive tape (commercially available from Nichiban Cellophane Tape, Japan) is attached to this freshly cut section and firmly sealed along this section. Finally, one end of the tape is lifted and removed in one motion. The amount of OPC coating removed from the drum (residual on the adhesive tape) is indicative of the level of adhesion of the organic OPC film to the inorganic (aluminum) substrate.

C. Voltage Tests $V_0$, $V_{L3}$, and $V_r$, are the original voltage, voltage at level 3, and residual voltage, respectively. The OPC drums are electronegatively charged to −700 volts ($V_0$). Then as they are discharged the voltage follows an asymptotically shaped curve to close to zero volts ($V_r$—the residual near zero volts at final discharge). $V_{L3}$ is an arbitrary point along the midpoint of the discharge curve between $V_0$ and $V_r$.

II. List of Materials Used In Examples

A. CGM:

Azo pigment:

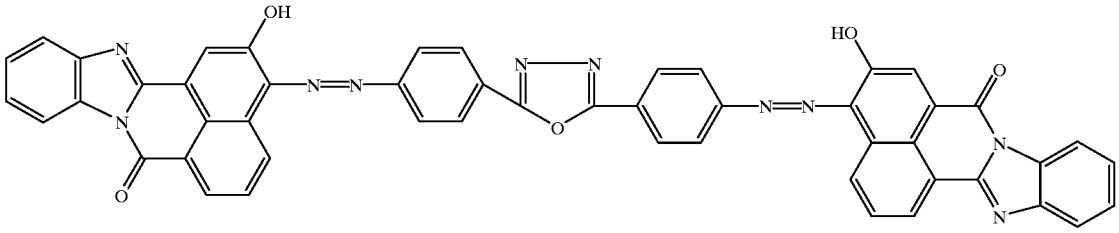

B. CGL Binders:

PKHH:

a polyhydroxyether which is a polymer of 4,4'-(1-methylethylidene)bisphenol with (chloromethyl)oxirane manufactured by Union Carbide and sold by Ucar and Phenoxy Associates of Rock Hill, S.C.

Polyvinyl Butyral Acetate:

PVBA-6000 sold by Sekisui Corp., Tokyo, Japan; Mw=40,000 to 80,000.

C. CGL Solvents:

1,2-Dimethoxyethane (DME)

Pentoxane (PTX)

D. CTM:

Benzamine, 4,4'-[methylenebis(oxy)]bis[N-phenyl-N-[4-(2-phenylethenyl)]phenyl]:

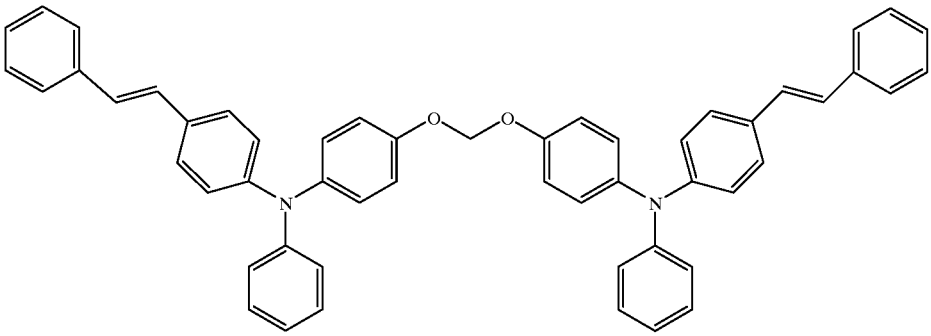

E. CTL Binders:

IUPILON Z-200, a poly[1,1-bis(4-phenylene) cyclohexane carbonate] having a $M_n$ of 19,259, a $M_w$ of 61,359 and a $M_z$ of 94,222, sold by Mitsubishi Gas Chemical of Japan.

IUPILON Z-400, a poly[1,1-bis(4-phenylene) cyclohexane carbonate] having a $M_n$ of 29,387, an Mw of 122,087, and an Mz of 195,960, sold by Mitsubishi Gas Chemical of Japan.

F. CTL Antioxidants:

Irganox 1076:

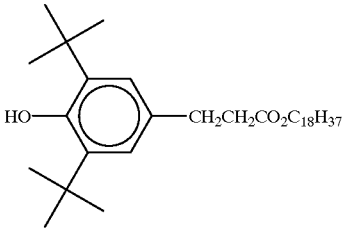

BHT:

Butylated Hydroxytoluene

G. CTL Stabilizers:

4-(2,2-dicyanoethylenyl)phenyl 2,4,5-trichlorobenzenesulfonate:

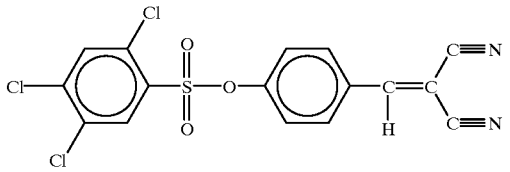

H. Silanes:

glycidyloxypropyltrimethoxysilane, commercially available from Dow-Corning.

phenoxytrimethoxysilane commercially available from Dow-Corning.

III. Examples

Example 1

2.5 Grams of azo pigment and 2.5 grams of binder (consisting of equal parts by weight of polyvinyl butyral (6000) and PKHH) were dissolved in 100 grams of a solvent (consisting of 90 parts by weight of DME and 10 parts by weight of PTX), by sand-mill dispersion for 6.0 hours. Then 2.6 grams of previously partially hydrolyzed glycidyloxypropyltrimethoxysilane were added to the resulting solution to afford a CGL coating solution. The glycidyloxypropyltrimethoxy silane was parially hydrolyzed by the addition of 0.1 parts of deionized water. The resulting CGL coating solution was applied by the aforementioned dip coating process onto an aluminum cylinder of 80×340 mm (used as the substrate) to form a charge generating layer (CGL) 0.65 micron in thickness. The substrate was cleaned in a conventional manner using a cleaning bath containing 1,1,1-trichloroethane prior to dip coating.

100 Grams of polycarbonate binder (consisting of 60 parts by weight of IUPILON Z-200 and 40 parts by weight of IUPILON Z-400) were blended and dissolved with 100 grams of the benzaminc, 4,4'-[methylenebis(oxy)]bis[N-phenyl-N-[4-(2-phenylethenyl)]phenyl] CTM in 1000 grams of a solvent (consisting of 65 parts by weight of tetrahydrofuran and 35 parts by weight of 1,4-dioxane). In addition, 8 parts of Irganox 1076, 0.03 parts of silicone oil, and 0.5 part of 4-(2,2-dicyanoethylenyl)phenyl 2,4,5-trichlorobenzenesulfonate, were added to the resulting solution. To this solution were added 4.8 grams of glycidyloxypropyltrimethoxysilane, which had been partially hydrolyzed by the addition of 0.1 parts of deionized water. The CTL was prepared by dip-coating and had a thickness of 28 microns as measured by Fischer Scope.

The adhesion of the complete, functional photoreceptor device was tested by a "cross-hatch" method. The adhesion results are shown in Table 1.

Example 2

2.5 Grams of azo pigment and 2.5 grams of binder (consisting of equal parts by weight of polyvinyl butyral (6000) and PKHH) were dissolved in 100 grams of a solvent (consisting of 90 parts by weight of DME and 10 parts by weight of PTX), by sand-mill dispersion for 6.0 hours. Then 2.6 grams of previously partially hydrolyzed glycidyloxypropyltrimethoxysilane were added to the resulting solution to afford a CGL coating solution. The glycidyloxypropyltrimethoxysilane was partially hydrolyzed by the addition of 0.1 parts of deionized water. The resulting CGL coating solution was applied by the aforementioned dip coating process onto an aluminum cylinder of 80×340 mm (used as the substrate) to form a charge generating layer (CGL) 0.65 micron in thickness. The substrate was cleaned in a conventional manner using a cleaning bath containing 1,1,1-trichloroethane prior to dip coating.

100 Grams of polycarbonate binder (consisting of 60 parts by weight of IUPILON Z-200 and 40 parts by weight of IUPILON Z-400) were blended and dissolved with 100 grams of the benzamine, 4,4'-[methylenebis(oxy)]bis[N-phenyl-N-[4-(2-phenylethenyl)]phenyl] CTM in 1000 grams of a solvent (consisting of 65 parts by weight of tetrahydroftiran and 35 parts by weight of 1,4-dioxane). In addition, 8 parts of Irganox 1076, 0.03 parts ol silicone oil, and 0.5 part of 4-(2,2-dicyanoethylenyl)phenyl 2,4,5-trichlorobenzenesulfonate, were added to the resulting solution. To this solution were added 48 grams of phenoxytrimethoxysilane, to afford a CTL coating solution. The CTL was prepared by dip-coating and had a thickness of 26 microns as measured by Fischer Scope.

The adhesion of the complete, functional photoreceptor device was tested by a "cross-hatch" method. The adhesion results are shown in Table 1.

Example 3

2.5 Grams of azo pigment and 2.5 grams of binder (consisting of equal parts by weight of polyvinyl butyral (6000) and PKHH) were dissolved in 100 grams of a solvent (consisting of 90 parts by weight of DME and 10 parts by weight of PTX), by sand-mill dispersion for 6.0 hours. The resulting CGL coating solution was applied by the aforementioned dip coating process onto an aluminum cylinder of 80×340 mm (used as the substrate) to form a charge generating layer (CGL) 0.65 micron in thickness. The substrate was cleaned in a conventional manner using a cleaning bath containing 1,1,1-trichloroethane prior to dip coating.

100 Grams of polycarbonate binder (consisting of 60 parts by weight of IUPILON Z-200 and 40 parts by weight of IUPILON Z-400) were blended and dissolved with 100 grams of the benzamine, 4,4'-[methylenebis(oxy)]bis[N-phenyl-N-[4-(2-phenylethenyl)]phenyl] CTM in 1000 grams of a solvent (consisting of 65 parts by weight of tetrahydrofuran and 35 parts by weight of 1,4-dioxane). In addition, 8 parts of Irganox 1076, 0.03 parts of silicone oil, and 0.5 parts of 4-(2,2-dicyanoethylenyl)phenyl 2,4,5-trichlorobenzenesulfonate, were added to the resulting solution. To this solution were added 4.8 grams of phenoxytrimethoxysilane, to afford a CTL coating solution. The CTL was prepared by dip-coating and had a thickness of 26 microns as measured by Fischer Scope. The adhesion of the complete, functional photoreceptor device was tested by a "cross-hatch" method. The adhesion results are shown in Table 1.

Example 4

2.5 Grams of azo pigment and 2.5 grams of binder (consisting of equal parts by weight of polyvinyl butyral (6000) and PKHH) were dissolved in 100 grams ol'a solvent (consisting of 90 parts by weight of DME and 10 parts by weight of PTX), by sand-mill dispersion for 6.0 hours. Then 2.6 grams of previously partially hydrolyzed glycidyloxypropyltrimethoxysilane were added to the resulting solution to afford a CGL coating solution. The glycidyloxypropyltrimethoxysilane was partially hydrolyzed by the addition of 0.1 parts of deionized water. The resulting CGL, coating solution was applied by the aforementioned dip coating process onto an aluminum cylinder of 80×340 mm (used as the substrate) to form a charge generating layer (CGL) 0.65 micron in thickness. The substrate was cleaned in a conventional manner using a cleaning bath containing 1,1,1-trichloroethane prior to dip coating.

100 Grams of polycarbonate binder (consisting of 60 parts by weight of IUPILON Z-200 and 40 parts by weight of IUPILON Z-400) were blended and dissolved with 100 grams of the benzamine, 4,4'-[methylenebis(oxy)]bis[N-phenyl-N-[4-(2-phenylethenyl)]phenyl] CTM in 1000 grams of a solvent (consisting of 65 parts by weight of tetrahydrofuran and 35 parts by weight of 1,4-dioxane). In addition, 8 parts of Irganox 1076, 0.03 parts of silicone oil, and 0.5 parts of 4-(2,2-dicyanoethylenyl)phenyl 2,4,5-trichlorobenzenesulfonate, were added to the resulting solution. The CTL was prepared by dip-coating and had a thickness of 26 microns as measured by Fischer Scope.

The adhesion of the complete, functional photoreceptor device was tested by a "cross-hatch" method. The adhesion results are shown in Table 1.

Comparative Example 1

2.5 Grams of azo pigment and 2.5 grams of binder (consisting of equal parts by weight of polyvinyl butyral (6000) and PKIIH) were dissolved in 100 grams of a solvent (consisting of 90 parts by weight of DME and 10 parts by weight of PTX), by sand-mill dispersion for 6.0 hours. The resulting CGL coating solution was applied by the aforementioned dip coating process onto an aluminum cylinder of 80×340 mm (used as the substrate) to form a charge generating layer (CGL) 0.65 micron in thickness. The substrate was cleaned in a conventional manner using a cleaning bath containing, 1,1,1-trichloroethane prior to dip coating.

100 Grams of polycarbonate binder (consisting of 60 parts by weight of IUPILON Z-200 and 40 parts by weight of IUPILON Z-400) were blended and dissolved with 100 grams of the benzamine, 4,4'-[methylenebis(oxy)]bis[N-phenyl-N-[4-(2-phenylethenyl)]phenyl] CTM in 1000 grams of a solvent (consisting of 65 parts by weight of tetrahydrofuran and 35 parts by weight of 1,4-dioxane). In addition, 8 parts of Irganox 1076, 0.03 parts of silicone oil, and 0.5 parts of 4-(2,2-dicyanoethylenyl)phenyl 2,4,5-trichlorobenzenesulfonate, were added to the resulting solution. The CTL was prepared by dip-coating and had a thickness of 25.5 microns as measured by Fischer Scope.

The adhesion of the complete, functional photoreceptor device was tested by a "cross-hatch" method. The adhesion results are shown in Table 1.

TABLE 1

| Example No. | Adhesion Level (Cross-Hatch Method: 1 = best; 5 = worst) | Vo/VL3/Vr (By Scanner) |
|---|---|---|
| Example 1 | 1 | 800/362/9 |
| Example 2 | 1 | 790/360/5 |
| Example 3 | 3 | 800/359/9 |
| Example 4 | 1 | 800/356/9 |
| Comparative Example 1 | 4–5 | 860/380/10 |

Obviously, numerous modifications and variations of the present invention are possible in light of the above teachings. It is therefore to be understood that, within the scope of the appended claims, the invention may be practiced otherwise than as spccifically described herein.

What is claimed as new and desired to be secured by Letters: Patent of the United States is:

1. A charge generation layer, prepared by a coating a substrate with a charge generation coating solution, wherein said charge generation coating solution is prepared by mixing:

(A) a binder;

(B) a charge generation material; and (C) an organosilane of the formula:

$$R_xSi(OR')_{4-x}$$

wherein:

R is

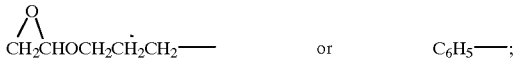

R' is H- or $C_{1-4}$-alkyl; and x is an integer of 1 to 3, in a suitable solvent.

2. The charge generation layer of claim 1, wherein said organosilane is selected from the group consisting of glycidyloxypropyltrimethoxysilane; glycidyloxypropyltrimethoxysilane, which has been hydrolyzed or partially hydrolyzed with deionized water; phenoxytrimethoxysilane; and phenoxytrimethoxysilane, which has been hydrolyzed or partially hydrolyzed with deionized water.

3. A charge transport layer, prepared by a coating a substrate with a charge transport coating solution, wherein said charge transport coating solution is prepared by mixing:

(A) a binder;

(B) a charge transport material; and (C) an organosilane of the formula:

$$R_xSi(OR')_{4-x}$$

wherein:

R is

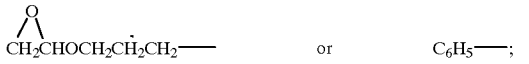

R' is H- or $C_{1-4}$-alkyl; and x is an integer of 1 to 3, in a suitable solvent.

4. The charge transport layer of claim 3, wherein said binder comprises a polycarbonate.

5. The charge transport layer of claim 3, wherein said charge transport material is selected from the group consisting of PY-DPH, CZ-DPH, and benzamine, 4,4'-[methylenebis(oxy)]bis[N-phenyl-N-[4-(2-phenylethenyl)]phenyl].

6. The charge transport layer of claim 3, wherein said organosilane is selected from the group consisting of glycidyloxypropyltrimethoxysilane; glycidyloxypropyltrimethoxysilane, which has been hydrolyzed or partially hydrolyzed with deionized water; phenoxytrimethoxysilane; and phenoxytrimethoxysilane, which has been hydrolyzed or partially hydrolyzed with deionized water.

7. An organic photoconductive imaging receptor comprising;

(i) a conductive metal substrate;

(ii) a charge generation layer coated on said substrate; and (iii) a charge transport layer coated on said charge generation layer, wherein said charge generation layer is prepared by coating a substrate with a charge generation coating solution, and wherein said charge generation coating solution is prepared by mixing:

(A) a binder;

(B) a charge generation material; and (C) an organosilane of the formula:

$R_xSi(OR')_{4-x}$ wherein:

R is

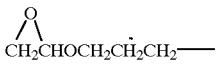

or $C_6H_5$—;

R' is H- or $C_{1-4}$-alkyl; and x is an integer of 1 to 3, in a suitable solvent.

8. Fhe organic photoconductive imaging receptor of claim 7, wherein said organosilane is selected from the group consisting of glycidyloxypropyltrimethoxysilane; glycidyloxypropyltrimethoxysilane, which has been hydrolyzed or partially hydrolyzed with deionized water; phenoxytrimethoxysilane; and phenoxytrimethoxysilane, which has been hydrolyzed or partially hydrolyzed with deionized water.

9. An organic photoconductive imaging receptor comprising;

(i) a conductive metal substrate;

(ii) a charge generation layer coated on said substrate; and (iii) a charge transport layer coated on said charge generation layer, wherein said charge transport layer is prepared by coating a substrate with a charge transport coating solution, and wherein said charge transport coating solution is prepared by mixing:

(A) a binder;

(B) a charge transport material; and (C) an organosilane of the formula:

$R_xSi(OR')_{4-x}$ wherein:

R is

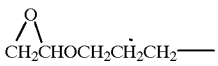

or $C_6H_5$—;

R' is H- or $C_{1-4}$-alkyl; and x is an integer of 1 to 3, in a suitable solvent.

10. The organic photoconductive imaging receptor of claim 9, wherein said binder comprises a polycarbonate.

11. The organic photoconductive imaging receptor of claim 9, wherein said charge transport material is selected from the group consisting of PY-DPH, CZ-DPH, and benzamine, 4,4'-[methylenebis(oxy)]bis[N-phenyl-N-[4-(2-phenylethenyl)]phenyl].

12. The organic photoconductive imaging receptor of claim 9, wherein said organosilane is selected from the group consisting of glycidyloxypropyltrimethoxysilane; glycidyloxypropyltrimethoxysilane, which has been hydrolyzed or partially hydrolyzed with deionized water; phenoxytrimethoxysilane; and phenoxytrimethoxysilane, which has been hydrolyzed or partially hydrolyzed with deionized water.

13. A process for preparing a charge generation layer, comprising dipping a substrate into a charge generation coating solution, wherein said charge generation coating solution is prepared by mixing:

(A) a binder;

(B) a charge generation material; and (C) an organosilane of the formula:

$R_xSi(OR')_{4-x}$ wherein:

R is

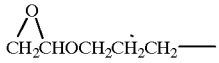

or $C_6H_5$—;

R' is H- or $C_{1-4}$-alkyl; and x is an integer of 1 to 3, in a suitable solvent.

14. The process of claim 13, wherein said organosilane is selected from the group consisting of glycidyloxypropyltrimethoxysilane; glycidyloxypropyltrimethoxysilane, which has been hydrolyzed or partially hydrolyzed with deionized water; phenoxytrimethoxysilane, and phenoxytrimethoxysilane, which has been hydrolyzed or partially hydrolyzed with deionized water.

15. A process for preparing a charge transport layer, comprising dipping a substrate into a charge transport coating solution, wherein said charge transport coating solution is prepared by a mixing:

(A) a binder;

(B) a charge transport material; and (C) an organosilane of the formula:

$R_xSi(OR')_{4-x}$ wherein:

R is

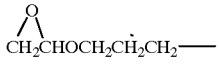

or $C_6H_5$—;

R' is H- or $C_{1-4}$-alkyl; and x is an integer of 1 to 3, in a suitable solvent.

16. The process of claim 15, wherein said binder comprises a polycarbonate.

17. The process of claim 15, wherein said charge transport material is selected from the group consisting of PY-DPH, CZ-DPH, and benzamine, 4,4'-[methylenebis(oxy)]bis[N-phenyl-N-[4-(2-phenylethenyl)]phenyl].

18. The process of claim 15, wherein said organosilane is selected from the group consisting of glycidyloxypropyltrimethoxysilane; glycidyloxypropyltrimethoxysilane, which has been hydrolyzed or partially hydrolyzed with deionized water; phenoxytrimethoxysilane; and phenoxytrimethoxysilane, which has been hydrolyzed or partially hydrolyzed with deionized water.

19. A photoconductive layer, selected from the group consisting of:

(I) a charge generation layer, prepared by coating a substrate with a charge generation coating solution, wherein said charge generation coating solution is prepared by mixing:

(A) a binder;
(B) a charge generation material; and
(C) an organosilane of the formula:

$R_xSi(OR')_{4-x}$ wherein:
R is

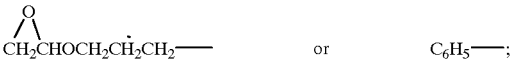

R' is H- or $C_{1-4}$-alkyl; and
x is an integer of 1 to 3,
in a suitable solvent; and (II) a charge transport layer, prepared by coating a substrate with a charge transport coating solution wherein said charge transport coating solution is prepared by mixing:
(A) a binder;
(B) a charge transport material; and
(C) an organosilane of the formula:

$R_xSi(OR')_{4-x}$ wherein:
R is

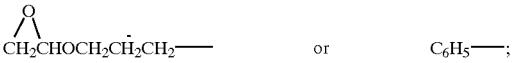

R' is H- or $C_{1-4}$-alkyl; and
x is an integer of 1 to 3,
in a suitable solvent.

20. An organic photoconductive imaging receptor, comprising:
(i) a conductive metal substrate;
(ii) a charge generation layer coated on said substrate; and
(iii) a charge transport layer coated on said charge generation layer,
wherein:
(I) said charge generation layer is prepared by coating a substrate with a charge generation coating solution, and wherein said charge generation coating solution is prepared by mixing:
(A) a binder;
(B) a charge generation material; and
(C) an organosilane of the formula:

$R_xSi(OR')_{4-x}$ wherein:
R is

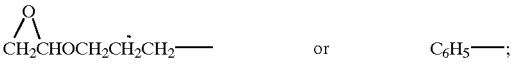

R' is H- or $C_{1-4}$-alkyl; and
x is an integer of 1 to 3.
in a suitable solvent, or (II) said charge transport layer is prepared by coating a substrate vvith a charge transport coating solution, and wherein said charge transport coating solution is prepared by mlixing:
(A) a binder;
(B) a charge transport material; and
(C) an organosilane of the formula:

$R_xSi(OR')_{4-x}$ wherein:
R is

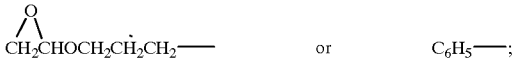

R' is H- or $C_{1-4}$-alkyl; and
x is an integer of 1 to 3,
in a suitable solvent.

21. A process for preparing a photoconductive layer, wherein said photoconductive laver is selected from the group consisting of charge generation layers and charge transport layers, and wherein said process comprises:

(I) dipping a substrate into a charge generation coating solution, wherein said charge generation coating solution is prepared by mixing:
(A) a binder;
(B) a charge generation material: and
(C) an organosilane of the formula:

$R_xSi(OR')_{4-x}$ wherein:
R is

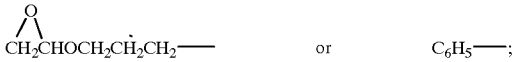

R' is H- or $C_{1-4}$-alkyl; and
x is an integer of 1 to 3,
in a suitable solvent; or (II) dipping a substrate into a charge transport coating solution, wherein said charge transport coating solution is prepared by a mixing:
(A) a binder;
(B) a charge transport material; and
(C) an organosilane of the formula:

$R_xSi(OR')_{4-x}$ wherein:
R is

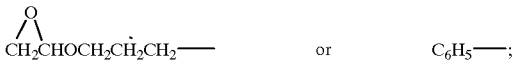

R' is H- or C1$_4$-alkyl; and
x is an integer of 1 to 3.
in a suitable solvent.

* * * * *